US005127320A

United States Patent [19]

Mei

[11] Patent Number: 5,127,320

[45] Date of Patent: Jul. 7, 1992

[54] ELECTRICAL STEEL SEAL PRINTING DEVICE

[76] Inventor: Wang C. S. Mei, 1F, No 31, Long 22, Shiang 22, Shen-Tzyy Jie, Taipei, Taiwan

[21] Appl. No.: 717,051

[22] Filed: Jun. 19, 1991

[51] Int. Cl.[5] ..... B31F 1/07; B41F 19/02; B44B 5/00

[52] U.S. Cl. ..... 101/3.1; 101/31.1

[58] Field of Search ..... 101/3.1, 31.1

[56] References Cited

U.S. PATENT DOCUMENTS 2,433,672 12/1947 May ..... 101/3.1

3,946,663 3/1976 Engeriser ..... 101/3.1

*Primary Examiner*—Edgar S. Burr

*Assistant Examiner*—Lynn D. Hendrickson

*Attorney, Agent, or Firm*—Bacon & Thomas

[57] ABSTRACT

An electrically operated steel seal printing device wherein the relative angle of the mold halves and the distance between the mold halves are adjustable.

1 Claim, 3 Drawing Sheets

ELECTRICAL STEEL SEAL PRINTING DEVICE

BACKGROUND OF THE INVENTION

1. Field of the Invention

The present invention relates to the field of technology pertaining to devices for imprinting a seal on the surface of a certification paper.

2. Description of the Prior Art

A printing device for impressing a seal on the surface of a certification paper is well known. The presence of the seal enhances the appearance of the certificate, such as one issued by a primary school or a university. Other certificate papers also require the impression of a seal to provide official certification of the paper, such as a patent or trademark certificate.

A conventional printing device for this purpose is manually operated, and is commonly known as a C-type steel seal printing device. Devices of this type are often used in schools or military installations, an example of which is shown in FIG. 1 wherein the basic structure includes three primary sections, including a C-shaped seat body 1, a feeding device 2 having a worm and worm gear, an upper steel mold 3 and a lower steel mold 4. Molds 3 and 4 are secured within respective upper and lower mold fixing blocks 10 and 11 on the opposite ends of the seat body 1. The article A to be impressed by the seal is placed onto the lower steel mold 4 and an operating handle 22 is pulled downwardly to rotate worm gear 21 which in turn causes worm 20 to move downwardly in a linear motion. This causes upper steel mold 3 to be pressed against the article so that the patterns carried by molds 3 and 4 are impressed in the article A.

Another known type of seal printing device is shown in FIG. 2. This type utilizes the principle of a lever. The manual operation of this device requires less energy than the operation of the previously described device, though the main structural characteristics of both devices are somewhat similar. The main difference being that the instant device does not include the worm and worm gear assembly.

However, known devices of the above types have been found to have certain disadvantages in structure and operation. For example, the upper and lower steel molds are securely fixed to their respective fixing blocks and are thus incapable of either rotary or linear adjustment. Also, the size of the seal impression on the article is confined to the limited space which is available due to the lack of adjustment. Further, manual operated printing devices are incapable of high production efficiency.

SUMMARY OF THE INVENTION

The present invention overcomes the disadvantages of known steel seal printing devices by providing an improved printing device which is electrically operated and permits adjustment of the relative angle between the upper and lower steel molds and also adjustment of the linear distance or gap between the upper and lower molds.

The main object of this invention is to provide an electrically operated steel seal printing device in which the angle of the upper and lower steel molds can be adjusted through rotation of the molds and thereby impress a seal at a desired location on the article without restriction of direction.

It is another object of the invention to provide an electrical steel seal printing device in which the distance or gap between the upper and lower steel molds can be adjusted to corresponds with the thickness of the article to be impressed, thus achieving the best possible impression.

It is a further object of the invention to provide an electrical steel seal printing device which is capable of absorbing a portion of the printing pressure, thereby enabling the device to achieve the best possible impression within a certain range of operation and without requiring adjustment of the gap between the upper and lower molds.

It is still another object of the invention to provide an electrical steel seal printing device which is capable of operating on a continuous basis and has a high production capacity.

Other objects, features and advantages of the invention shall become apparent from the following detailed description of a preferred embodiment thereof, when taken in conjunction with the drawings wherein like reference characters refer to corresponding parts in the several views.

DETAILED DESCRIPTION OF THE PREFERRED EMBODIMENT

Figure 1:
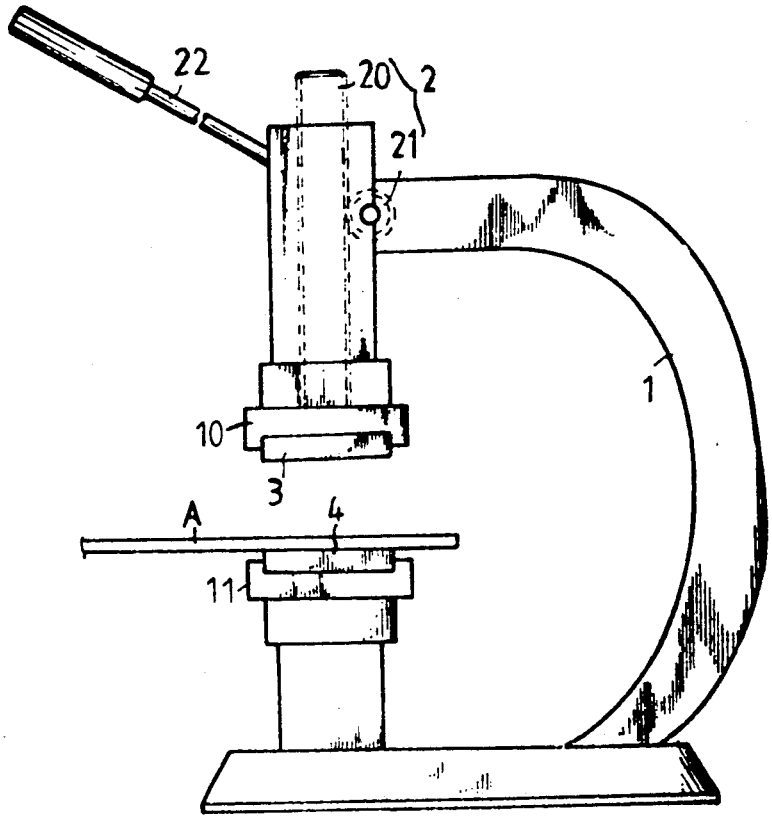
FIG. 1 (PRIOR ART)
FIG. 1 is a front elevational view, partly in section, of a conventional steel seal printing device of a first type.
Figure 2:
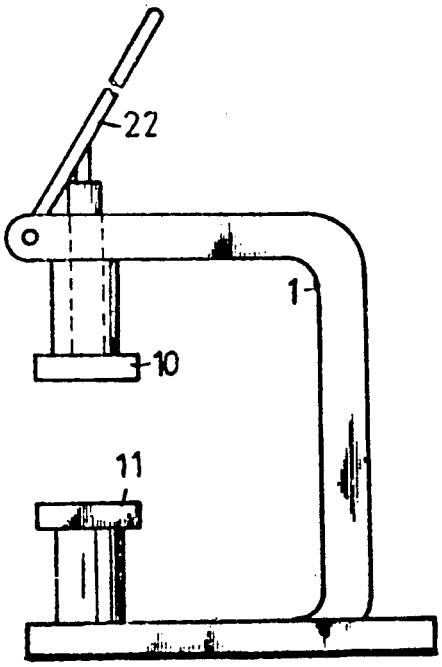
FIG. 2 (PRIOR ART)
FIG. 2 is a front elevational view, partly in section, of a conventional steel seat printing device of a second type.
Figure 3:
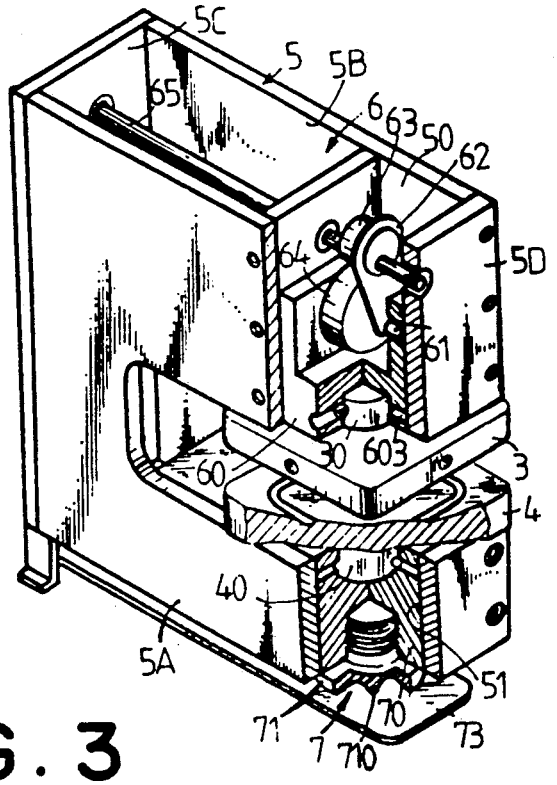
FIG. 3 is a perspective view, partly broken away, showing an electrical steel seal printing device according to the present invention.
Figure 6:
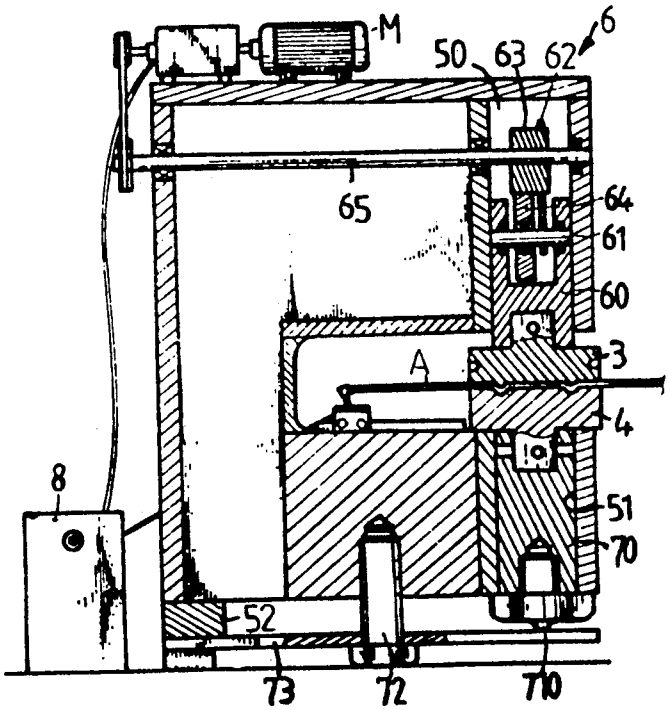
FIG. 6 is the same view as FIG. 5, but showing the upper and lower molds impressing the seal on the article.
Figure 5:
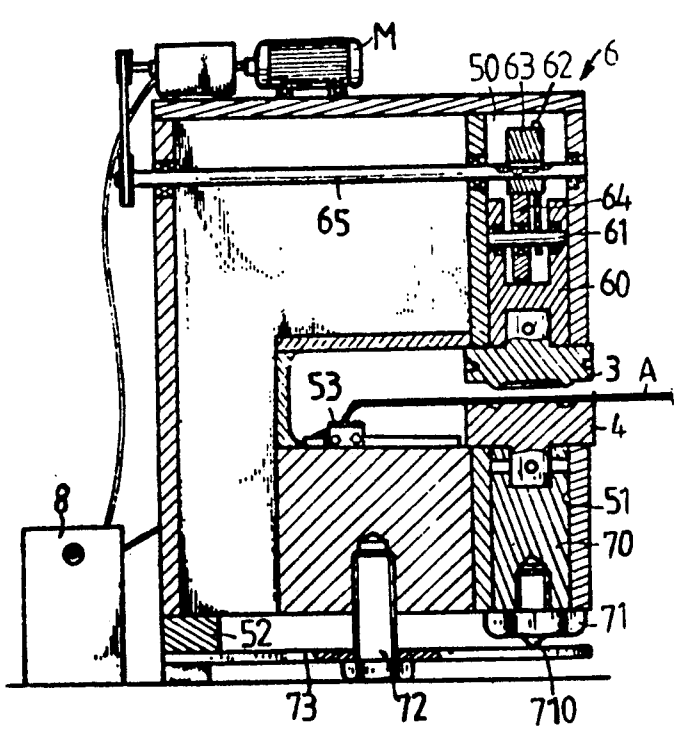
FIG. 5 is a front elevational cross-sectional view showing an article inserted between the upper and lower molds just prior to the impressing operation.

With initial reference to FIG. 3, there is shown a steel seal printing device according to the invention. The device includes a C-shaped body 5, an upper mold seat 3, a lower mold seat 4, a driving mechanism 6, and a gap adjusting device 7. The device also includes an electric circuit control device 8, as indicated in FIGS. 5 and 6.

Body 5 is partially formed from a pair of opposed C-shaped side plates 5A and 5B, and a pair of opposed end plates 5C and 5D, all of which are secured together by the use of screws or other appropriate fastening means. Body 5 also includes an square-shaped upper compartment 50 and an opposed square-shaped lower compartment 51. A portion of driving mechanism 6 is housed within upper compartment 50, including an axle rod 61, a crank 62 rotatably joined with an eccentric wheel 63. Also included is a bearing 64 having an outer circumferential plane disposed in engagement with eccentric wheel 63 for rotation by a drive shaft 65, the latter also forming a part of mechanism 6. As seen in FIGS. 5 and 6, drive shaft 65 is driven by an electric motor M.

A U-shaped mold fixing seat 60 is also disposed in upper compartment 50 for engagement by upper mold 3, and a corresponding mold fixing seat 70 is disposed within lower compartment 51 for engagement by lower mold 4. Axle rod 61 is secured within opposed walls of upper mold fixing seat 60, so rotation of drive shaft 65 will cause upper mold fixing seat 60 to move linearly towards or away from opposed lower mold fixing seat 70 by virtue of the engagement between eccentric wheel 63 and bearing 64. This produces a synchronized upward or downward straight line reciprocating motion for upper mold 3 relative to lower mold 4 during operation of motor M, depending on the direction of rotation of drive shaft 65.

Figure 4:
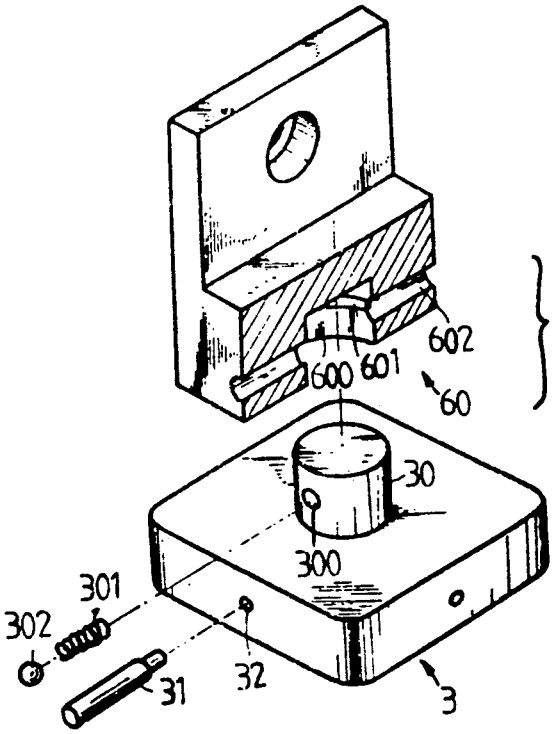
FIG. 4 is a perspective exploded view, showing the details of the upper mold and its associated mold fixing seat.

With further reference to FIG. 4, the structural details of upper and lower mold fixing seats 60 and 70 shall now be described, though only with reference to seat 60. It shall be understood that corresponding structural details of this description are also found in seat 70. As indicated, seat 60 includes a circular hole 600 provided with an annular groove 601 positioned approximately midway between the outer ends of hole 600. Four cylindrical passages 602 extend radially outwardly from the center of hole 600 through seat 60, with passages 602 being spaced 90° from each other. The inner end of each passage 602 terminates in a semi-circular hole 603 having a radius that exceeds the radius of annular groove 601.

Upper mold 3 is provided with an outwardly extending cylindrical body 30 which is correspondingly configured and sized for disposition within hole 600 of seat 60. However, it is to be understood that hole 600 and column 30 may also be of another corresponding configuration, such as polygonal. Column 30 is provided with a transverse passage 300 within which a compression spring 301 and a steel ball 302 are received. When column 30 is disposed within hole 600, ball 302 is spring-biased into engagement within annular groove 601, thus securing upper mold 3 within upper mold seat 60 and permitting relative rotation of mold 3 relative to mold seat 60 and the selective indexing of ball 302 into each of the four semicircular holes 603. This rotation is manually realized by providing mold 3 with a circular aperture 32 within which an inner end of a push rod handle 31 is inserted. By grasping handle 31, mold 3 may be rotated to provide different positions of the seal design carried thereby relative to the spot on the article desired to be impressed by the seal. The same structural details also apply for lower mold 4.

The gap or distance between the opposed surfaces of upper and lower molds 3, 4 may be adjusted by adjusting device 7 which is essentially in the form of a screw having a nut in the form of a base portion 71 that is at least larger than the sectional area of the lower mold fixing seat 70, within which it is threadedly secured. Device 7 also includes a downwardly extending cone-shaped protrusion 710 which is positioned along its central axis. A bottom plate 73 is secured to the device by a screw 72. A square body 52 is disposed between plate 72 and body 5, as indicated in FIG. 5. As is apparent, the lower end of protrusion 710 engages the upper surface of plate 73 so that when device 7 is threaded into or out of lower mold seat 70, the latter is caused to be lowered or raised, respectively. This results in a corresponding widening or narrowing of the gap between molds 3 and 4. As also apparent from this arrangement, a portion of the printing or punching force applied to upper mold seat 3 may be absorbed by bottom plate 73. This is especially beneficial when a second lot of articles being impressed is not excessively different in thickness from the first lot, thereby permitting the realization of similar impression results as when the distance between molds 3 and 4 is preadjusted.

With particular reference to FIGS. 5 and 6, electric circuit control device 8 includes a microswitch 53 positioned at the mouth of the C-shaped body 5. The position of microswitch 53 is adjustable and is in accordance with the final position of an article A desired to be impressed between upper and lower molds 3,4. Thus, engagement of microswitch 53 by article A activates microswitch 53 to generate a signal which is transmitted to electric circuit control device 8. The latter then activates electric motor M which connects with a clutch (not shown) for operation of drive shaft 65. Rotation of the latter causes a corresponding rotation of eccentric wheel 63 and crank 62, which in turn rotates bearing 64 and thereby causes upper mold 3 to conduct an upward/downward straight line reciprocating motion. When mold 3 is brought downwardly against mold 4, an impression is printed on article A, as shown in FIG. 6.

In some cases, article A being impressed is excessively large so that the direction of the positioning of article A between upper and lower molds 3, 4 do not match with the seal patterns thereon. Thus, it may be difficult or impossible to precisely impress the seal in the desired location on article A. When this situation arises, insertion of the push rod handle 31 into the circular holes formed in the peripheral edge of upper and lower molds 3, 4 permits the user to rotate molds 3, 4 until the seal pattern coincides with the direction of the article and may thus be impressed at the desired location thereon.

The invention therefor provides an improved electrically operated steel seal printing device which includes a C-shaped case body, upper and lower mold seats, upper and lower molds, a drive mechanism, a mold seat gap adjustment device and an electric circuit control device. Moreover, the upper and lower molds are secured within their respective mold seats through spring-biased steel balls which are engaged within annular grooves formed in the mold seats to permit the upper and lower molds to be rotated and indexed relative to each other, and thereby vary the angle of the corresponding seal impressions carried by the molds.

I claim:

1. An electrical steel seal printing device comprising upper and lower steel molds, means for mounting said steel molds for rotation about an axis, means to adjust the distance between said molds, a body having a C-shaped opening, said body being formed by securing two C-shaped plates and plural flat plates together to form upper and lower square guiding compartments which intersect said C-shaped opening, a drive mechanism including a drive shaft rotatably mounted in said body, a motor, an eccentric wheel carried by said drive shaft and positioned in the upper guiding compartment, and a crank having one end connected to said eccentric wheel, said upper mold being provided with a U-shaped upper mold fixing seat having a bearing thereon, an axle rod received in said bearing of said U-shaped seat, a second end of said crank being connected to said axle rod such that when said drive shaft is rotated by said motor, said upper mold is moved up and down, a lower mold fixing seat disposed in the lower guiding compartment, said means to adjust the distance between said molds including a first screw located under said lower mold fixing seat, said first screw having a cone-shaped protrusion and a base portion, a bottom plate, a second screw securing said bottom plate to said body, a square body, said second screw holding a portion of said bottom plate in engagement with said square body, another portion of said bottom plate supporting said first screw to secure said lower mold fixing seat, said distance between said molds being adjustable by said first screw, a circular column body provided on each of said molds, a hole in each of said circular column bodies, a compression spring and a steel ball biased by said compression spring in each hole, four semi-circular holes in each mold seat for selective engagement by the steel ball of its corresponding mold so that the angles of the upper and lower molds may be adjusted through rotation of the molds.

* * * * *